US007159584B2

(12) United States Patent
Maeda et al.

(10) Patent No.: US 7,159,584 B2
(45) Date of Patent: Jan. 9, 2007

(54) AIRGUN FIRING MECHANISM

(75) Inventors: Tetsuo Maeda, Tokyo (JP); Yoshiyuki Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 126 days.

(21) Appl. No.: 10/445,914

(22) Filed: May 28, 2003

(65) Prior Publication Data

US 2004/0237952 A1 Dec. 2, 2004

(51) Int. Cl.
*F41B 11/02* (2006.01)

(52) U.S. Cl. ..... 124/41.1; 42/60; 89/33.02

(58) Field of Classification Search ..... 124/56; 42/89, 90

See application file for complete search history.

(56) References Cited

U.S. PATENT DOCUMENTS 2,980,096 A * 4/1961 Merz ..... 124/74
3,191,333 A * 6/1965 Koltun ..... 42/59
3,913,553 A * 10/1975 Braughler et al. ..... 124/73
4,422,433 A * 12/1983 Milliman ..... 124/74
4,445,419 A * 5/1984 Fischer ..... 89/33.02
4,709,617 A * 12/1987 Anderson ..... 89/157
5,160,795 A 11/1992 Milliman
5,261,178 A * 11/1993 Samish ..... 42/89
6,481,137 B1 * 11/2002 Kornberger ..... 42/59

* cited by examiner

*Primary Examiner*—Troy Chambers
(74) *Attorney, Agent, or Firm*—Foley & Lardner LLP

(57) ABSTRACT

The airgun firing mechanism of the present invention has a rotary magazine 1 with a plurality of bores 11 made from a material through which magnetic force can pass, and a magnet 10 is provided in the center of the magazine 1. Also, the airgun firing mechanism of the present invention has inner diameters of respective bores 11 of the rotary magazine 1 having a plurality of bores 11 formed to inner diameters capable of having pellets 91 inserted into them, with the magazine 1 being formed from a material that can pass magnetic force, and with a magnet 10 being provided in the center of the magazine 1. In this way, it is possible to repeatedly fire two different types of bullets, namely BB bullets 90 and pellets 91, using one magazine 1 of one airgun G.

18 Claims, 11 Drawing Sheets

AIRGUN FIRING MECHANISM

BACKGROUND OF THE INVENTION

1. Field of Invention

The present invention relates to an airgun firing mechanism. Specifically, the present invention relates to a firing mechanism for a repeat fire airgun having one magazine with a plurality of rotary bores, that can be loaded with both spherical BB (ball bearing) bullets and diabolo-shaped pellets in this single magazine, capable of repeated firing no matter what shaped bullets are loaded in the magazine.

2. Description of the Background Art

Conventionally, two different types of bullets, known as ball shaped BB bullets and shaped pellets are used in an airgun. Generally, BB bullets are used in an airgun specifically designed to be capable of firing only BB bullets, and pellets are used in an airgun specifically designed to be capable of firing only pellets.

A BB bullet-only airgun and a pellet-only airgun are known in both single shot type and repeater type using a magazine.

For example, a firing mechanism for a repeater type airgun is disclosed in U.S. Pat. No. 5,160,795 "Gun with pivoting barrel, rotary ammunition cylinder, and double-action firing mechanism" 'related art 1'). The rotary ammunition cylinder 49 of related art 1 is described as using pellets inside bores 52 (column 3, lines 3–7).

However, airguns capable of using BB bullets and pellets are also known, but such airguns are capable of a repeat action with the use of a magazine for BB bullets, but for pellets a magazine is not used but rather the airguns are manually loaded single-shot airguns.

On the other hand, BB bullets and pellets are incompatible as they are made from different materials, and have different shapes and dimensions. Specifically, BB bullets are steel balls having a diameter of 4.3–4.5 mm, while pellets are lead diabolo-shaped cylinders having a maximum diameter of 4.6–4.8 mm.

Therefore, with a repeat-action airgun using a magazine, it is not possible to use both BB bullets and pellets of differing diameters together, and repeated firing is carried out using either a BB bullet-only magazine or a pellet-magazine having bores that have a diameter corresponding to the diameter of the respective bullets or pellets used. That is, the inner diameter of a single bore of a BB bullet-only magazine is 4.3–4.5 mm, while the inner diameter of a single bore of a pellet-only magazine is 4.6–4.8 mm. Accordingly, even if BB bullets are put into the bore of a pellet-only magazine, they cannot be held inside the bore and roll out because they are spherical. Conversely, it is not possible to put pellets into the bore of a BB bullet-only magazine, and if an attempt is made to do so, the pellets will simply become distorted in shape or broken because they are made of lead.

SUMMARY OF THE INVENTION

The airgun firing mechanism of the present invention has a rotary magazine with a plurality of bores made from a material through which magnetic force can pass, and a magnet is provided in the center of the magazine.

Also, the airgun firing mechanism of the present invention has inner diameters of respective bores of a rotary magazine having a plurality of bores formed to inner diameters capable of having pellets inserted into them, with the magazine being formed from a material that can pass magnetic force, and a magnet is provided in the center of the magazine. As a result, it is possible to hold steel BB bullets inside the bores using magnetic force, and it is also possible to stably hold pellets inside the bores using bores with an inner diameter that is made the same as the outer diameter of pellets having an outer diameter larger than that of a BB bullet. The inner diameter of the bores is preferably 4.6–4.8 mm.

It is also possible to simply fit a magazine to an airgun by forming a tip of a pivot pin, which the center of the axis of rotation of the magazine is fitted to, from a material that is magnetically inductive, and it is possible to reliably hold the magazine to the pivot pin using magnetic force.

The effect of the present invention is that it becomes possible to perform repeated firing of both BB bullets and pellets that have different sizes and shapes, and are made of different materials, using an air gun having a single rotary magazine.

BRIEF DESCRIPTION OF THE DRAWINGS

FIG. 1 is an explanatory drawing showing attachment of an airgun magazine to an airgun body.

FIG. 2 is a cross sectional front view of an airgun having bores of a magazine loaded with BB bullets.

FIG. 3 is cross sectional drawing along line AA in FIG. 2.

FIG. 4 is an expanded cross sectional front view of a magazine having bores loaded with BB bullets.

FIG. 5 is a view in the direction of arrow B in FIG. 4.

FIG. 6 is a view in the direction of arrow C in FIG. 4.

FIG. 7 is an expanded partial explanatory drawing of a state where one of the bores is loaded with a BB bullet.

FIG. 8 is an expanded cross sectional view of a magazine having bores loaded with pellets.

FIG. 9 is a view in the direction of arrow D in FIG. 8.

FIG. 10 is a view in the direction of arrow E in FIG. 8.

FIG. 11 is an expanded partial explanatory drawing of a state where one of the bores is loaded with a pellet.

DESCRIPTION OF THE PREFERRED EMBODIMENTS

A description will now be given of a firing mechanism for an airgun, being one preferred embodiment of the present invention.

An airgun G uses injection pressure of a gas such as compressed air or compressed $CO_2$ gas as a source of pressure for a firing mechanism, and is constructed so as to fire BB bullets or pellets loaded inside a magazine 1.

Figure 1:
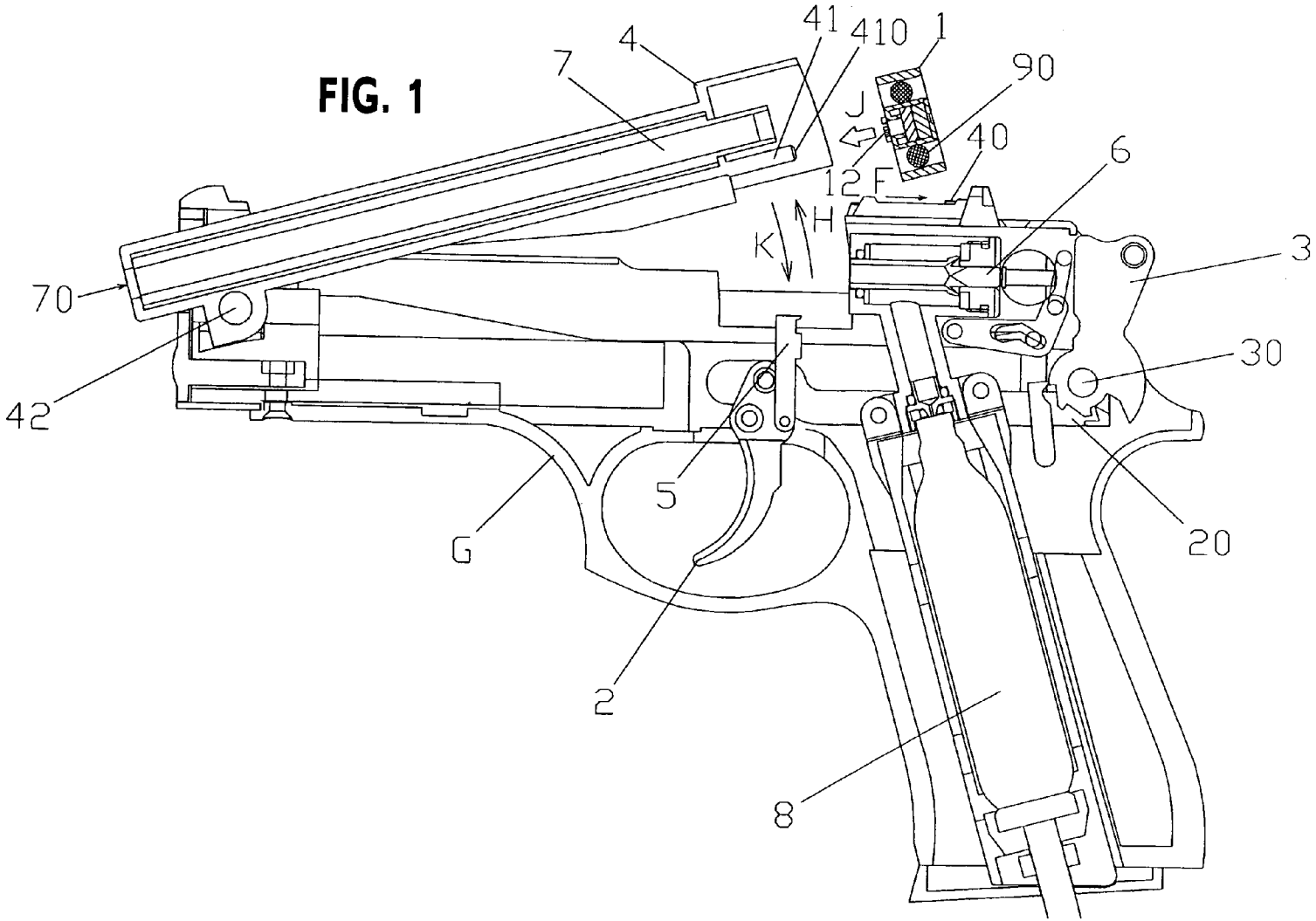
FIGS. 1–11 show one embodiment of the present invention.
Figure 2:
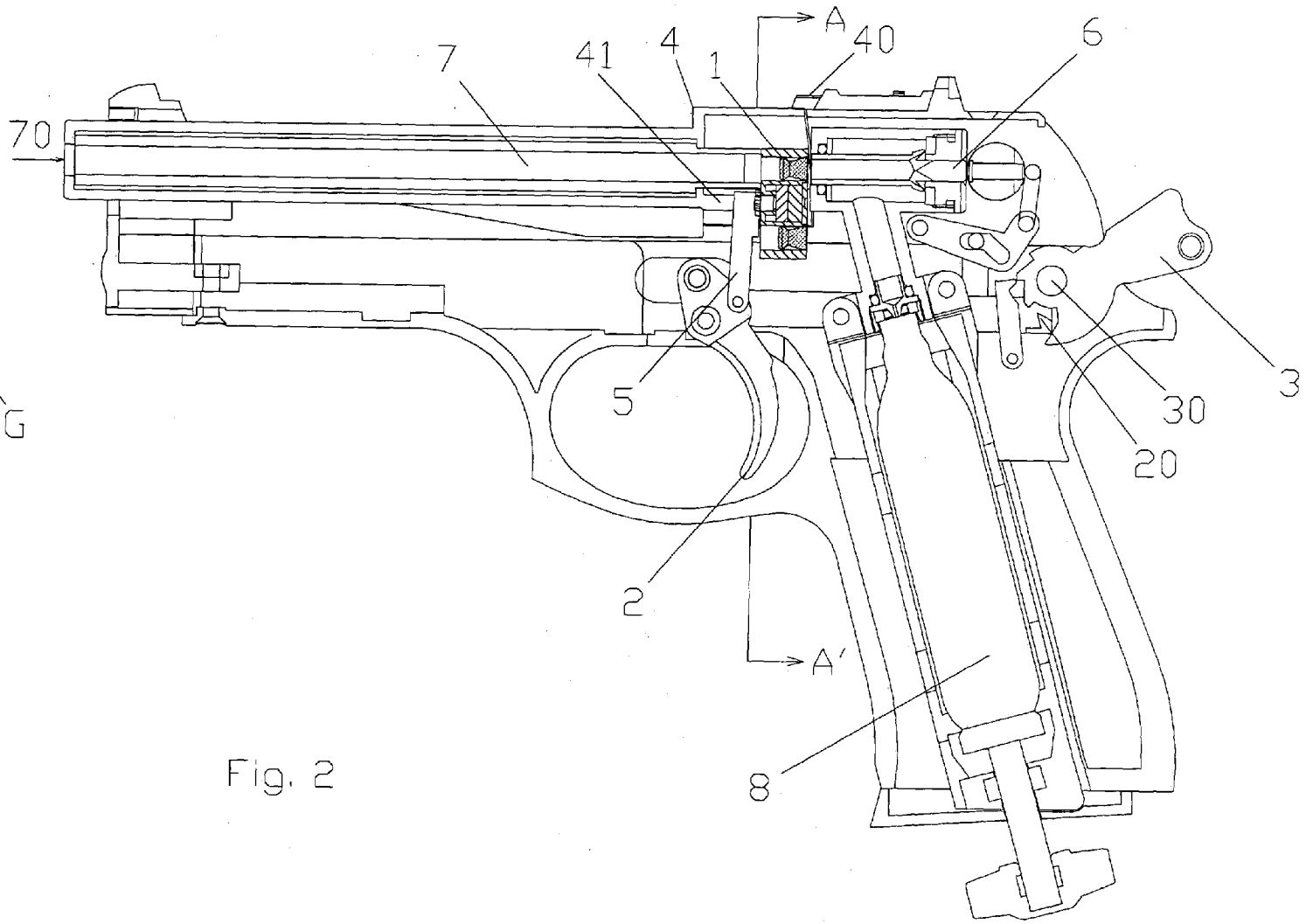
Figure 3:
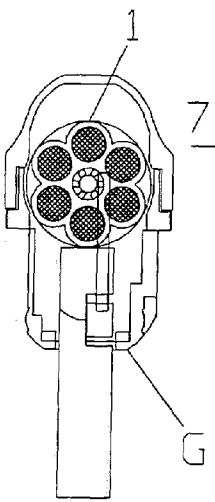
Figure 4:
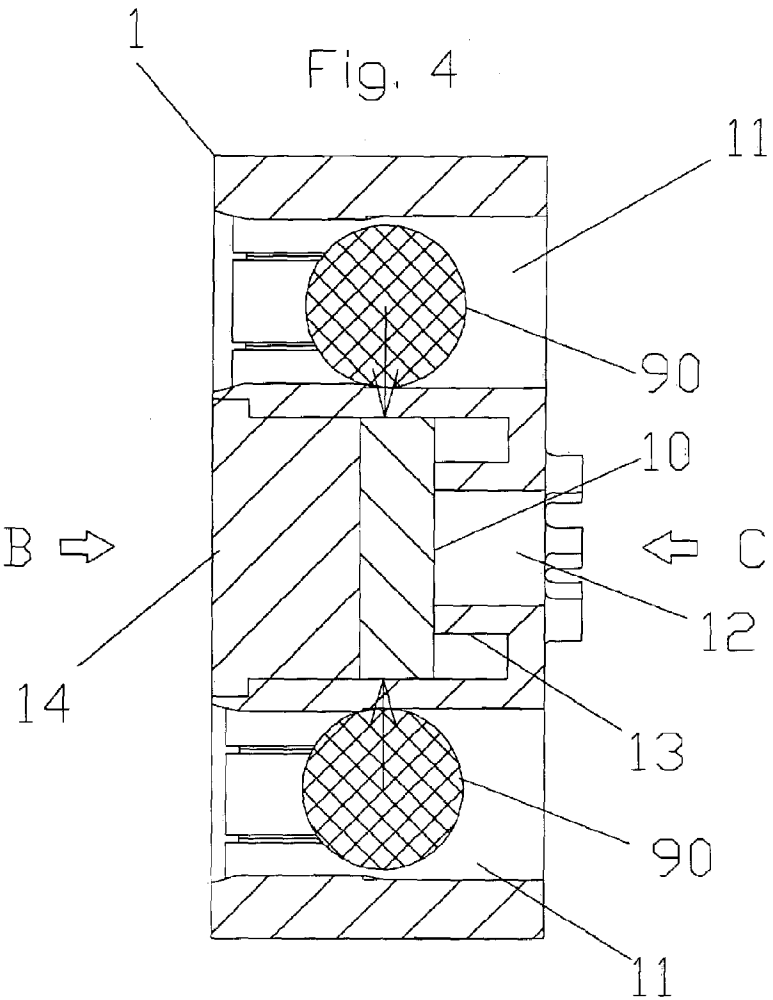
Figure 5:
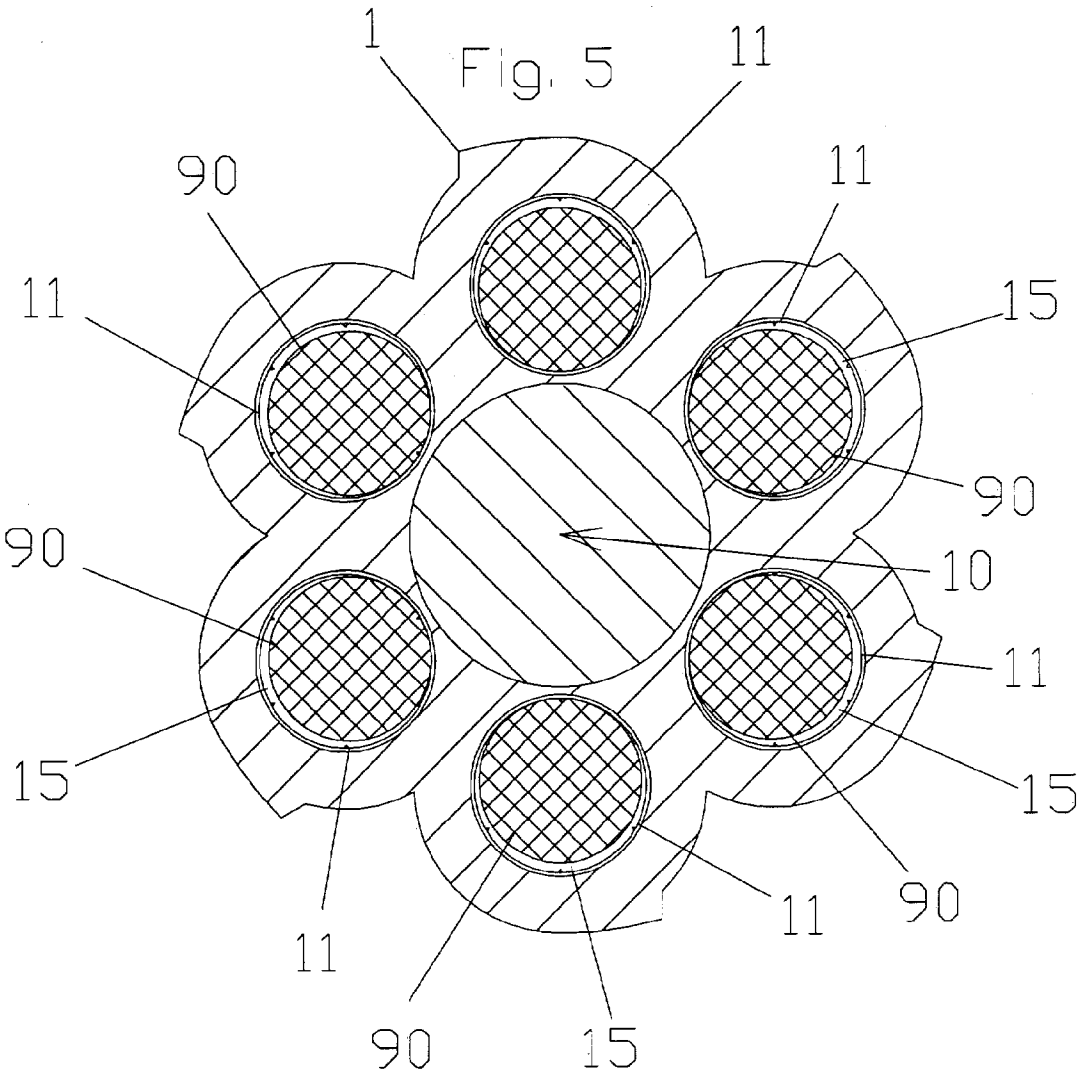
Figure 6:
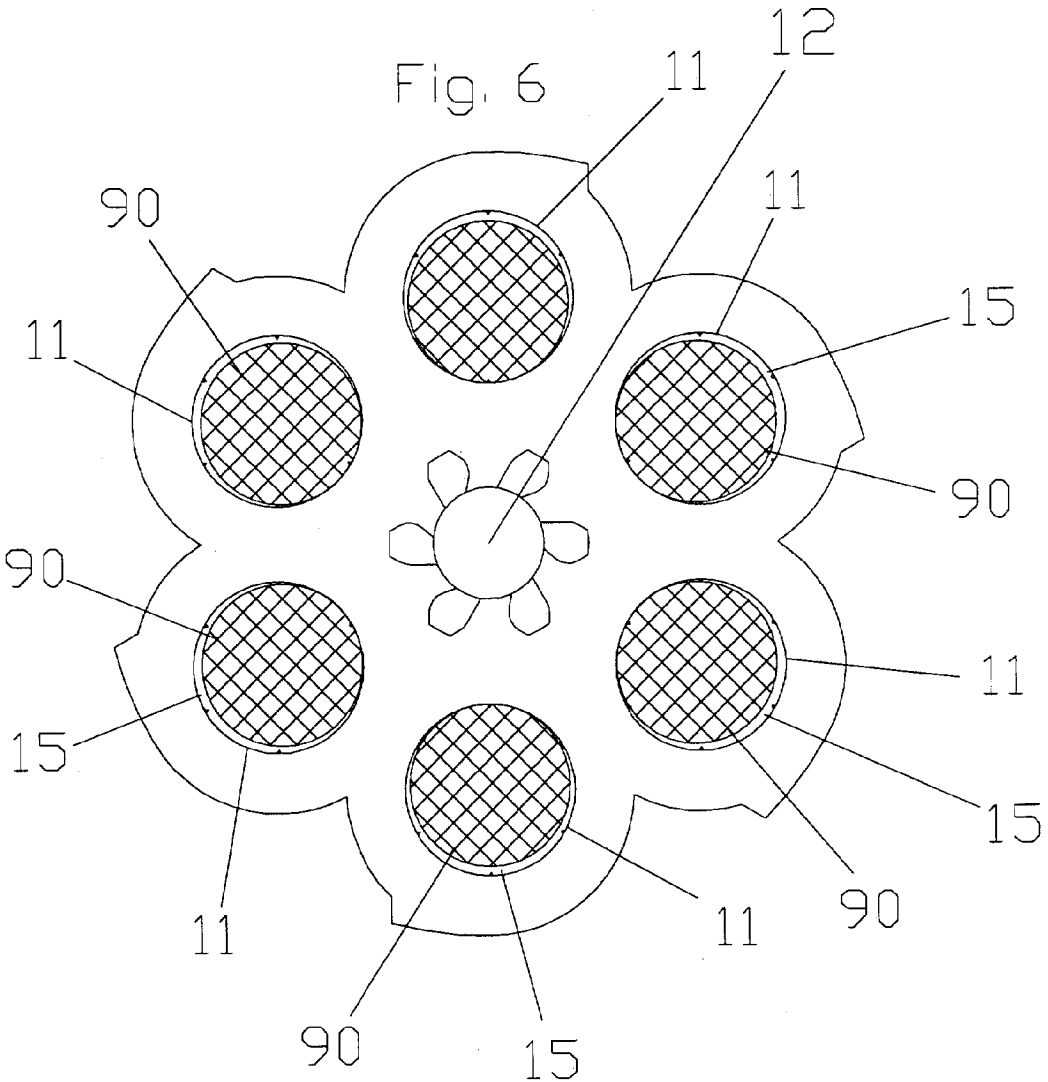
Figure 7:
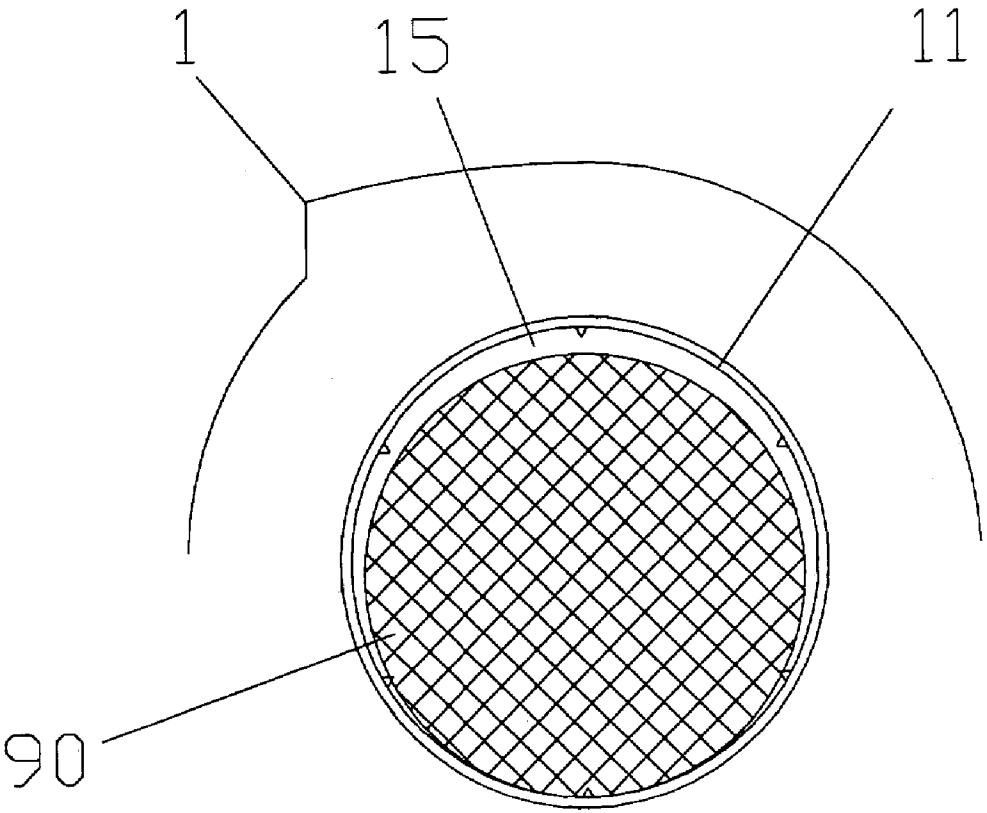
Figure 8:
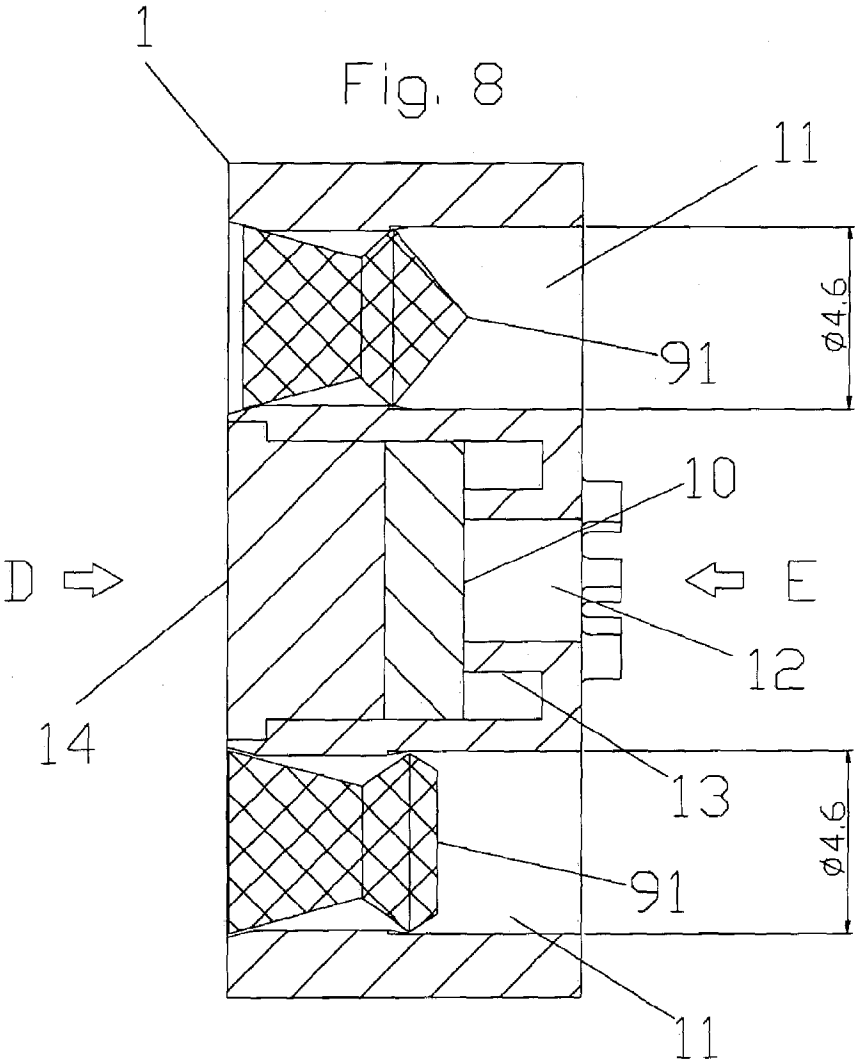
Figure 9:
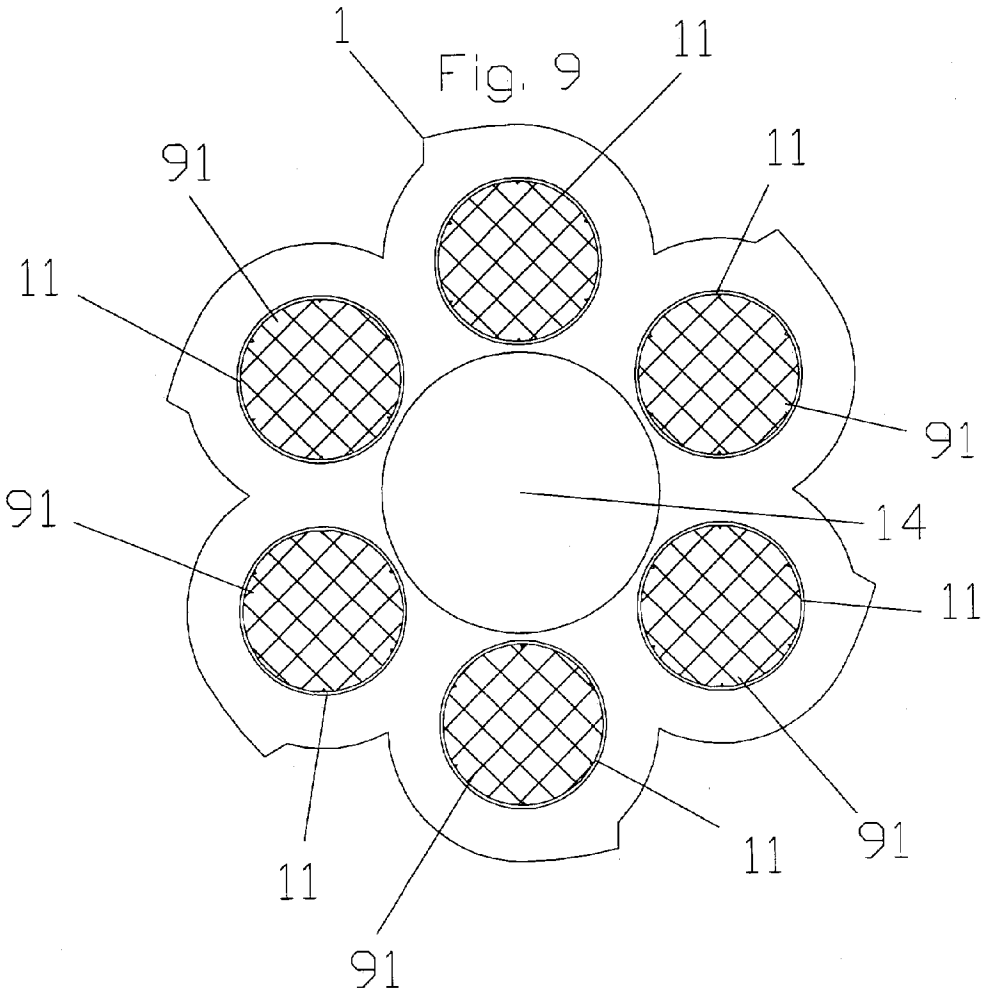
Figure 10:
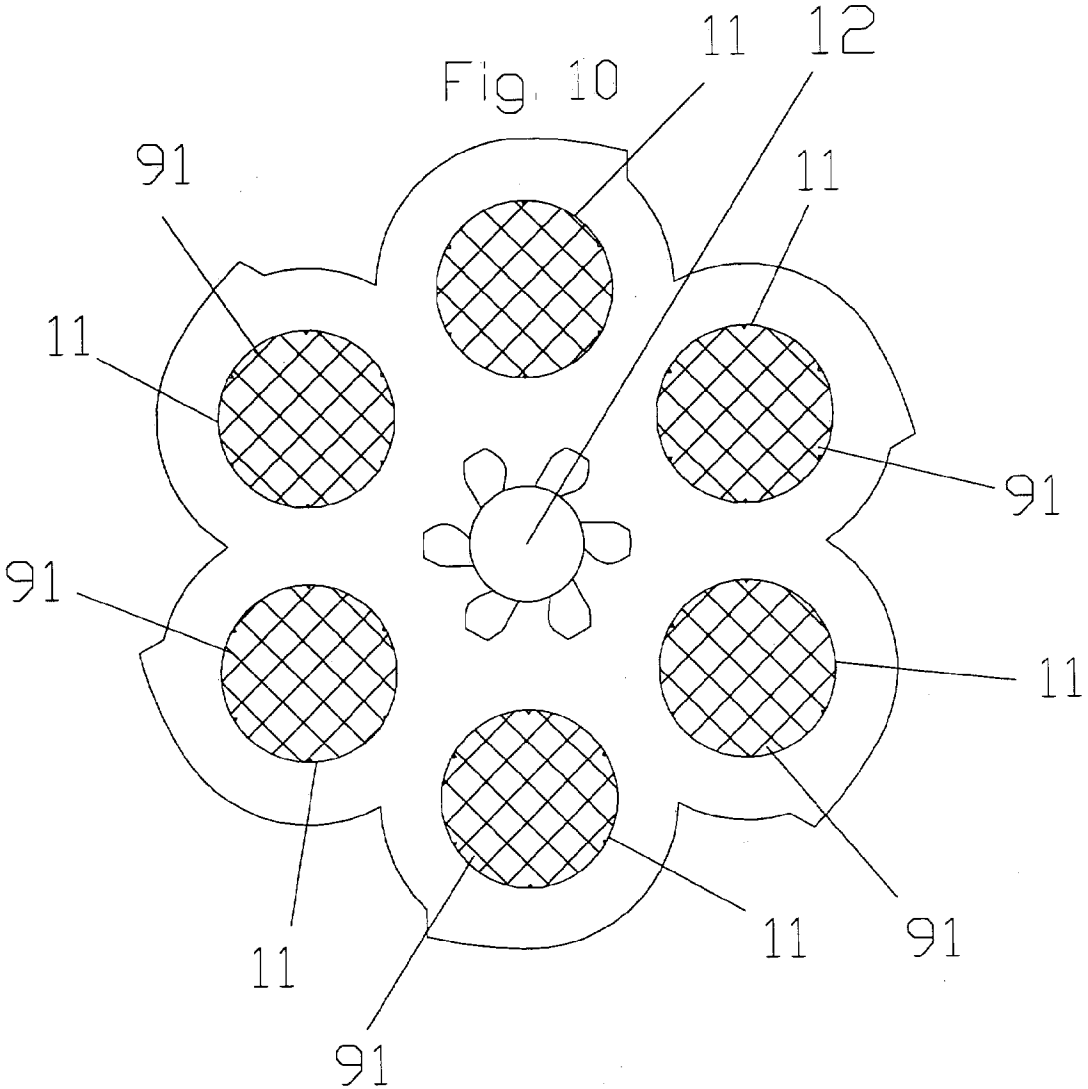
Figure 11:
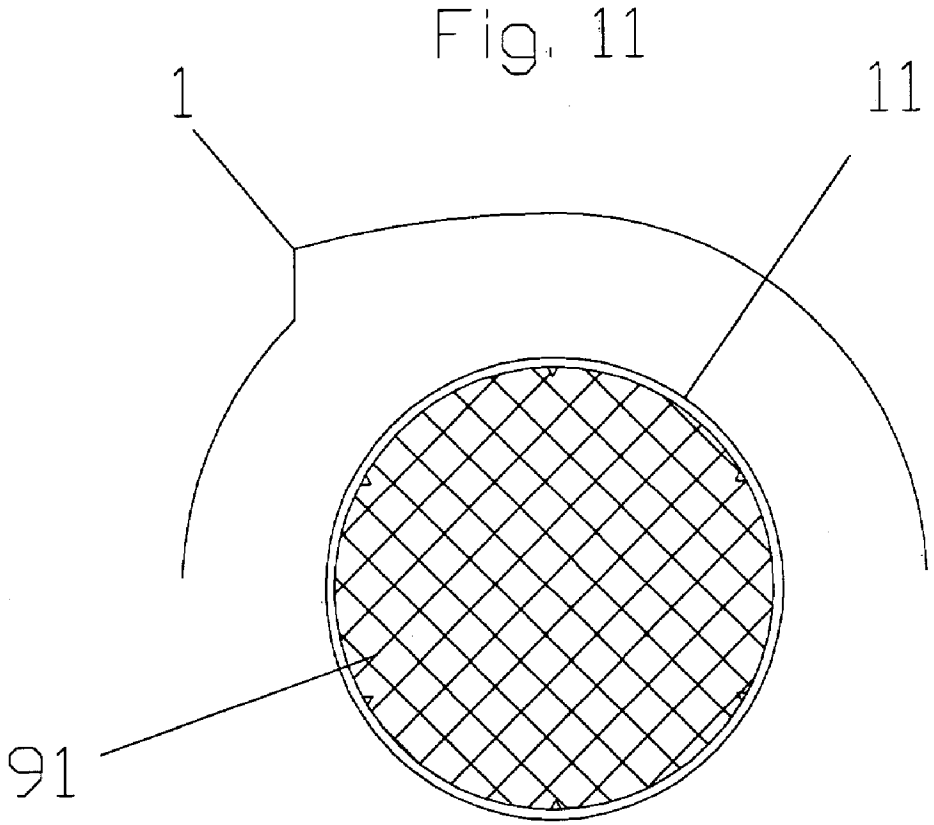

The main structural components of the firing mechanism of the airgun G are, as shown in FIG. 1 to FIG. 3, a rotary magazine 1, a trigger 2, a hammer 3, a trigger bar 20, a barrel assembly 4, a barrel assembly lock 40, a pivot pin 41, a transfer bar 5, a valve pin 6, a barrel 7 and an air tank 8.

The trigger 2 is connected via the trigger bar 20 to the hammer 3, and also connected to the magazine 1 via the transfer bar 5. The hammer 3 and the a rotary magazine 1 are therefore provided in such a way as to be rotated by pulling the trigger 2.

The transfer bar 5 causes rotation of the rotary magazine 1, and causes the barrel 7 and the centers of the bores 11 to coincide. The hammer 3 strikes the valve pin 6 under the resilient force of a spring, to cause compressed air or compressed carbon dioxide to be injected from the air tank 8 and fire a bullet (BB bullet or pellet) from the bores 11.

The structure of the rotary magazine 1 of the firing mechanism of the airgun G is shown in enlarged form in FIG. 4 to FIG. 11.

The rotary magazine 1 is made from a material that can pass magnetic force, is a disk shape having a certain thickness, and has a plurality of bores 11.

The material of the rotary magazine 1 is plastic or hard synthetic resin etc., but any material can be used as long as it is a hard material capable of allowing magnetic force to pass.

The thickness of the magazine 1 is 9.0–10.0 mm in this embodiment, and a circumferential side surface is a side surface having indented sections coinciding with the outer shape of the respective bores 11.

Each of the bores 11 is formed from a cylindrical section having a center on the circumference equidistant from the center 100 of the magazine, and positioned the same distance apart from one another.

The inner diameters of the respective bores 11 are the same size as outer diameters of pellets 91 having a larger outer diameter than BB bullets 90. Generally, the outer diameter of BB bullets 90 is 4.3 mm, and the inner diameter of the bores 11 is preferably 4.6–4.8 mm. Also, the number of bores 11 formed in a single magazine 1 is six in this embodiment, but any number is possible as long as it is possible to load bullets and rotation of the magazine 1 is possible.

A magnet 10 is provided at a central part of the magazine 1.

The magnet 10 has magnetic force to attract bullets made from a magnetically inductive material inserted inside the bores 11, for example steel BB bullets 90, and keep them stationary inside the respective bores 11. The magnet 10 is also made from a material that does not lose its magnetic force over a long time. In this embodiment, the material of the magnet 10 is neodymium, but a magnet made from other materials is also possible.

The magnet 10 is cylindrical with a thickness of 2.0–5.0 mm and a diameter of 4.0–7.0 mm, and is provided in the center of the magazine 1 in a substantially central part in the thickness direction of the magazine 1. A distance between the outer surface of the magnet 10 and the respective bores 11 should be small (narrow) so as to cause the magnetic force to act strongly, and in this embodiment it is about 0.5 to 1.0 mm.

Reference numeral 12 is a rotational axis hole, that is a rotational axis core, of the magazine 1, and 13 is a magnetic presser section forming an inner surface of the rotational axis hole.

Reference numeral 14 is a fixed section provided on an opposite side to the rotational axis hole 12 in the thickness direction of the magazine 1, with the magnet 10 interposed between the rotational axis hole 12 and the fixed section.

Therefore, the magnet 10 is fixed by the magnetic presser section 13 and the fixed section 14 at a central position of the magazine 1 substantially in the middle in a thickness direction, from both sides in the thickness direction.

Next, a description will be given of the operation of the firing mechanism of the airgun G representing the embodiment of the present invention.

Beforehand, bullets to be used at that time are loaded into the magazine 1 that was previously ejected from the barrel assembly 4 of the airgun G.

If the bullets to be used this time are pellets 91, since the outer diameters of the pellets 91 and the inner diameters of the bores 11 are the same, as shown in FIG. 8 to FIG. 11, soft lead pellets 91 have their outer parts in contact with the inner surface of the bores 11 and are held inside the bores 11 by contact friction. With this embodiment, the maximum outer diameter of the pellets 91 is 4.6 mm, the same as the inner diameter of the bores 11.

Also, if the bullets used are BB bullets 90, the inner diameter of the bores 11 is larger than the outer diameter of the BB bullets 90. Since the magnet 10 is in the middle of the magazine 1 and the material of the magazine 1 allows magnetic force to pass through, inside the bores 11, the BB bullets 90 are attracted by magnetic force towards the center of the magazine 1, as shown in FIG. 4 to FIG. 7. As a result, as shown in an enlarged manner in FIG. 7, a gap 15 occurs inside a single bore 11 between the inner surface of the bore 11 and the spherical surface of the BB bullet 90.

As with the embodiment of claim 3, if the magnet 10 is at a position at a central part in the thickness direction of the magazine 1, the BB bullets 90 are held stationary inside the bores 11 at the central position in the thickness direction of the magazine 1, and so are held at a more stable position inside the bores 11.

With this embodiment, the inner diameter of the bores 11 is 4.6 mm, and the outer diameter of the BB bullets 90 is 4.3 mm.

Figure 12:
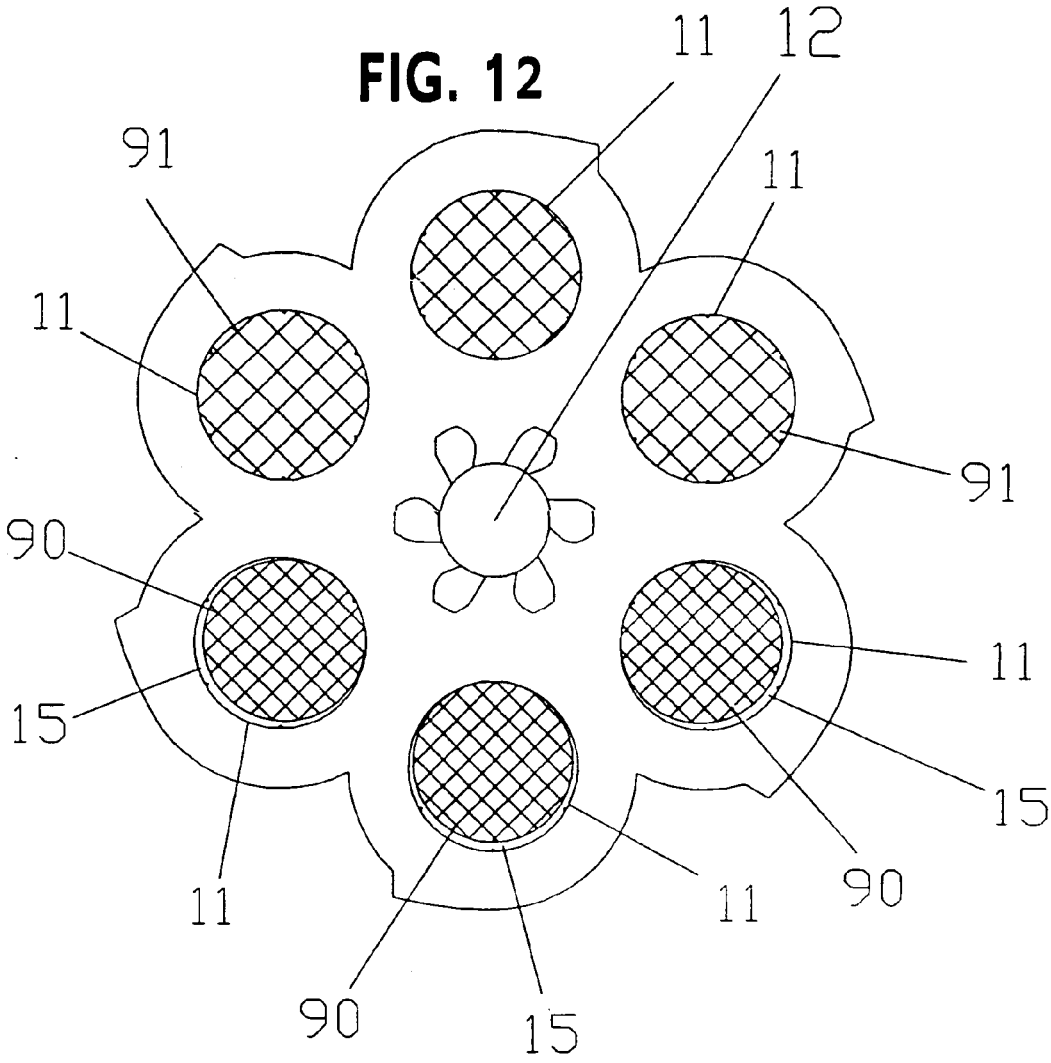
FIG. 12 is a view similar to that of FIG. 6 and FIG. 10, showing a magazine holding a combination of BB bullets and pellets.

In this embodiment, the bullets loaded in the magazine 1 are of the same type, either all BB bullets 90 or all pellets 91, but it is also possible to load a combination of BB bullets 90 and pellets 91 (for example as shown in FIG. 12) and carry out repeat firing.

Next, as shown in FIG. 1, if the barrel assembly lock 40 is pulled towards the rear of the airgun G (in the direction of arrow F), the barrel assembly 4 is rotated upwards (in the direction of arrow H), with the rotation shaft 42 at the muzzle 70 side of the gun barrel as a center.

The magazine 1 is attached to the tip end 410 of the pivot pin 41 provided on the upwardly rotated barrel assembly 4 so as to be freely rotatable (attachment is in the direction of arrow J). This attachment is carried out by slipping the rotational axis hole 12 of the magazine 1 over the tip end 410 of the pivot pin 41. The pivot pin 41 is formed with at least the tip end 410 being of a magnetically inductive material, for example steel. Therefore, simple coupling is enabled by attraction to the magnetic force of the magnet 10 being provided close to the rotational axis hole 12 of the magazine 1, after coupling retention is also stable. With this embodiment, the whole of the pivot pin 41 is made of steel. Also, even if the pivot pin 41 is made from a material that is not magnetically inductive, there is no problem as long as it is a circular shaft having an outer diameter that enables reliable attachment to the rotational axis hole 12.

Next, the barrel assembly 4 is rotated downwards (in the direction of arrow K), and returned to a position where it can be abutted against the barrel assembly lock 40.

In this state, as the trigger 2 begins to be pulled, the hammer 3 is rotated backwards about the fulcrum 30 against the resistance of the spring force of the spring, via the trigger bar 20, and if the trigger 2 is pulled fully back, the hammer 3 then rotates forward around the fulcrum 30 due to the resilient force of the spring and strikes the valve pin 6.

As a result of the hammer 3 striking the valve pin 6, a gas such as compressed air or $CO_2$ gas is caused to spurt out from the air tank 8, firing the BB bullets 90 or pellets 91 loaded in the bores 11 of the magazine 1.

The magazine 1 is loaded on the pivot pin 41 so as to be freely rotatable, and if the trigger 2 starts to be pulled back, the magazine 1 is rotated by the transfer bar 5 connected to the trigger 2, and immediately before the trigger 2 is pulled, the center of one bore 11 of the magazine 1 loaded with a bullet to be fired is aligned with the center of the barrel 7. Then, if pulling back of the trigger 2 has finished, compressed air or $CO_2$ gas is jetted out and the BB bullet 90 or pellet 91 inside one of the bores 11 is fired from the muzzle 70.

BB bullets 90 are also fired along way by the thrust force of the gas which is stronger than the magnetic force of the magnet 10.

By repeating these operations, it is possible to repeatedly fire BB bullets 90 or pellets 91 that have been loaded in the bores 11 of the rotary magazine 1.

If all the bullets in the magazine 1 are fired, the barrel assembly lock 40 is again pulled to the rear of the airgun G and the barrel assembly 4 opened upwards, the empty magazine 1 is removed from the pivot pin 41, and the next BB bullets 90 or pellets 91 are loaded into the bores 11. A magazine 1 loaded with the next BB bullets 90 or pellets 91 is fitted onto the tip end 410 of the pivot pin 41, and the barrel assembly 4 is rotated downwards to abut against the barrel assembly lock 40.

After that, bullets are repeatedly fired using the operation described above, whether they are BB bullets or pellets.

The present invention has the following effects.

In a firing mechanism for an airgun, as well as forming the magazine 1 from a material that allows magnetic force to pass, there is a magnet 10 in the middle of the magazine 1, and it is possible to stably hold spherical BB bullets 90 having an outer diameter that is smaller than the inner diameter of the bores 11 inside the bores 11 using the magnetic force of the magnet 10.

Also, the inner diameter of the bores 11 of the magazine 1 is such that is corresponds to the outer diameter of normally used pellets 91, which means that it is also possible to load and use pellets 91 that are available on the market, as in the related art.

Accordingly, with the present invention, using one firing mechanism of one airgun G, it is possible to repeatedly fire both normally used BB bullets 90 and pellets 91.

Also, by providing a magnet 10 in the middle of the magazine 1, as in claim 3, and making the tip end 410 of the pivot pin 41 fitted into the rotational axis core 12 of the magazine 1 from a magnetically inductive material, it is easy to fit the magazine 1 to the pivot pin 41, and engagement with the pivot pin 41 is stable.

Further, with a structure where the position of the magnet 10 is the position of the central part in a thickness direction of the magazine 1, as in claim 4, since the BB bullets 90 are stationary inside the bores 11 at central portions in the thickness direction of the magazine 1, they are held at a more stable position inside the bores 11.

What is claimed is:

1. A firing mechanism for an airgun, comprising:

a rotary magazine adapted to selectively hold pellets, BB bullets having a diameter smaller than the diameter of the pellets, and a combination of the pellets and the BB bullets, and a magnet provided in a middle of the magazine.

2. The firing mechanism of claim 1, wherein the magazine is adapted to provide the combination of the pellets and the BB bullets for repeatedly firing from the airgun two different types of projectiles using one magazine.

3. The firing mechanism of claim 1, wherein the magazine is adapted to fire steel BB's.

4. The firing mechanism of claim 1, wherein the magazine is adapted to fire lead pellets.

5. The firing mechanism of claim 1, wherein the magazine is adapted to fire projectiles with a frustum base.

6. The firing mechanism of claim 1, wherein the magazine includes bores;

wherein the magazine is adapted to fire BB's with diameters smaller than the inner diameters of the bores, and wherein the magazine is adapted to fire pellets with diameters substantially the same as the inner diameters of the bores.

7. An airgun comprising:

a firing mechanism including a rotary magazine adapted to selectively hold pellets, BB bullets having a diameter smaller than the diameter of the pellets, and a combination of the pellets and the BB bullets, and a magnet provided in a middle of the magazine.

8. The airgun of claim 7, wherein the airgun is adapted to repeatedly fire two different types of projectiles using one magazine containing the combination of the pellets and the BB bullets.

9. The airgun of claim 7, wherein the airgun is adapted to fire steel BB's.

10. The airgun of claim 7, wherein the airgun is adapted to fire lead pellets.

11. The airgun of claim 7, wherein the airgun is adapted to fire projectiles with a frustum base.

12. The airgun of claim 7, wherein the magazine includes bores;

wherein the magazine is adapted to fire BB's with diameters smaller than the inner diameters of the bores, and wherein the magazine is adapted to fire pellets with diameters substantially the same as the inner diameters of the bores.

13. A firing mechanism for an airgun, comprising:

a rotary magazine having a plurality of bores and made from a material capable of passing magnetic force, and a magnet provided in the middle of the magazine, wherein the magnet is adapted to connect the magazine to a pivot pin of the airgun so that the magazine is incorporated into the airgun when the airgun is prepared to fire.

14. The firing mechanism for an airgun of claim 13, wherein the magnet provided in the middle of the magazine is at a substantially central position in the thickness direction of the magazine, wherein the magnet is adapted to retain the magazine against a pivot pin of the airgun.

15. A firing mechanism for an airgun, comprising:

a rotary magazine having a plurality of bores, inner diameters of the respective bores having a size that enables pellets to be inserted, and the magazine made from a material capable of passing magnetic force, with a magnet being provided in the middle of the magazine, wherein the magnet is adapted to connect the magazine to the airgun so that the pellets are adapted to be fired from the magazine.

16. The firing mechanism for an airgun of claim 15, wherein the magnet provided in the middle of the magazine is at a substantially central position in the thickness direction of the magazine, wherein the magnet is adapted to retain the magazine against a pivot pin of the airgun.

17. A firing mechanism for an airgun, comprising:

a rotary magazine having a plurality of bores and made from a material capable of passing magnetic force, a magnet provided in the middle of the magazine, and a tip end of a pivot pin of an airgun adapted to fit into a rotational axis core of the magazine and made from a magnetically inductive material, wherein the magazine is connected to the airgun by the pivot pin.

18. The firing mechanism for an airgun of claim 17, wherein the magnet provided in the middle of the magazine is at a substantially central position in the thickness direction of the magazine, wherein the magnet is adapted to retain the magazine against a pivot pin of the airgun.

* * * * *